United States Patent [19]

Motomura

[11] Patent Number: 4,928,933

[45] Date of Patent: May 29, 1990

[54] ELECTROMAGNETIC MOLTEN METAL SUPPLY SYSTEM

[75] Inventor: Noriyuki Motomura, Zama, Japan

[73] Assignee: Toshiba Kikai Kabushiki Kaisha

[21] Appl. No.: 332,174

[22] Filed: Apr. 3, 1989

[51] Int. Cl.[5] ..... C21C 5/42

[52] U.S. Cl. ..... 266/237; 266/94; 222/591; 417/50; 164/147.1; 164/155

[58] Field of Search ..... 164/146, 147.1, 155, 164/156, 457, 498, 500; 266/94, 95, 237; 222/591; 417/50

[56] References Cited

U.S. PATENT DOCUMENTS

| | | | |
|---|---|---|---|
| 3,942,577 | 3/1976 | Uozumi et al. | 164/500 |
| 4,714,102 | 12/1987 | Koya | 164/500 |
| 4,828,460 | 5/1989 | Saito et al. | 164/147.1 |

FOREIGN PATENT DOCUMENTS

| | | | |
|---|---|---|---|
| 95620 | 12/1983 | European Pat. Off. | 164/457 |
| 102018 | 3/1984 | European Pat. Off. | 164/500 |

*Primary Examiner*—Richard K. Seidel

[57] ABSTRACT

This invention relates to an electromagnetic molten metal supply system in a die cast machine and so forth, in which an electromagnetic pump is immersed in a furnace for maintaining molten metal, and the supply tube of the pump is connected to an injection cylinder. The electromagnetic pump is provided with two groups of coils, one of which is for maintaining the molten metal and the other group of coils for supplying the molten metal, and these two coils are controlled separately.

3 Claims, 2 Drawing Sheets

ELECTROMAGNETIC MOLTEN METAL SUPPLY SYSTEM

BACKGROUND OF THE INVENTION

1. Field of the Invention

The present invention relates to an electromagnetic molten metal supply system more, particularly, the invention relates to an electromagnetic molten metal supply system for maintaining the surface height of molten metal in a molten metal maintaining furnace to a fixed height by controlling a dip type of cylinder electromagnetic pump and reducing variation of the quantity of the molten metal supplied.

2. Description of the Related Art

As a conventional electromagnetic molten metal supply system, the one having the structure illustrated in FIG. 2 has been known. Referring to FIG. 2, in the molten metal maintaining furnace 1 in which a fixed quantity of molten metal is contained, a dip type cylinder electromagnetic pump 2 is disposed. The exciting current to be supplied to an exciting coil 3 of the electromagnetic pump 2 is regulated by a controller 4 and a molten metal surface detecting signal is supplied from a molten metal surface detecting instrument 5 to this controller 4. Further, the electromagnetic pump 2 is connected to a molten metal supply tube 6, the supply outlet of which is communicated with the injection sleeve 7 of a die cast machine. The reference numeral 8 in FIG. 2 is an injection plunger of the die cast machine.

In the above structure, the exciting current for maintaining the molten metal surface at a certain level is supplied from the controller 4 to the excitation coil 3 of the electromagnetic pump 2 in response to the output signal supplied from the molten metal surface detecting instrument 5, thereby the water head H between the level L1 of the molten metal surface in the molten metal supply tube 6 and the molten metal surface level of the furnace 1 is controlled so as to be constant. On the other hand, in a molten metal supply cycle, by changing the current being supplied to the exciting coil 3 through the controller 4, the molten metal is supplied up to a predetermined level L2 of the injection sleeve 7. Moreover, the molten metal thus supplied is injected in the die cavity to the die cast machine (not shown) by the displacement of the injection plunger 8.

Thus, since the conventional electromagnetic molten metal supply system is designed to change the current directed to the exciting coil 3 alternatively when controlling the molten metal surface level of the furnace 1 and controlling the molten metal supply quantity, it is difficult to keep the molten metal surface level constant with accuracy while supplying the molten metal, which has caused the variation of the supply quantity and the deterioration of the molding stability of the die cast products.

To solve the above problems, it may be attempted to employ a furnace where the molten metal surface is kept constant or to maintain the molten metal surface constant with the provision of a separate electromagnetic pump. In this case, however, a considerable increase in equipment cost becomes unavoidable.

SUMMARY OF THE INVENTION

An object of the present invention is to provide an electromagnetic molten metal supply system for supplying a fixed quantity of molten metal constantly while precisely maintaining a molten metal surface by controlling the molten metal surface of a molten metal maintaining furnace and the molten metal supply separately by a single electromagnetic pump.

To attain the above object, the electromagnetic molten metal supply system according to the present invention has an electromagnetic pump for supplying a fixed quantity of molten metal contained in the molten metal maintaining furnace through a supply tube. The device includes an exciting coil of the electromagnetic pump which is divided into a first exclusive coil for maintaining the surface of the molten metal in the furnace and a second exclusive coil for supplying the molten metal so that the first and second coils are separately controlled.

According to the present invention, by exciting the first exclusive coil the output of the pump is used to precisely control and maintain the molten metal surface precisely, and by exciting the second exclusive coil the output of the pump is used to control the supply of the fixed quantity of the molten metal.

DETAILED DESCRIPTION OF THE PREFERRED EMBODIMENT

Figure 1:
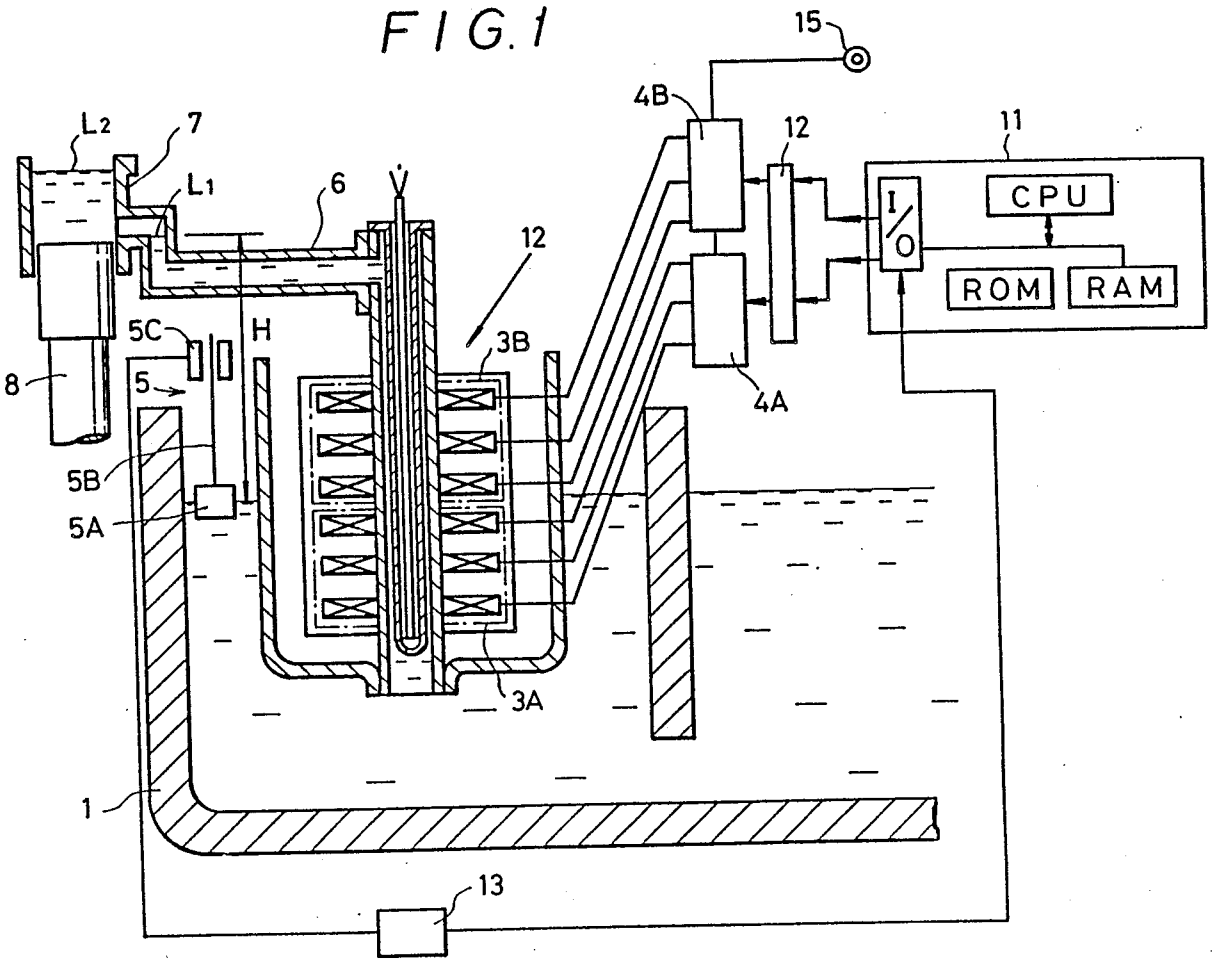
FIG. 1 is a schematic block diagram showing one embodiment of an electromagnetic molten metal supply system according to the present invention.
Figure 2:
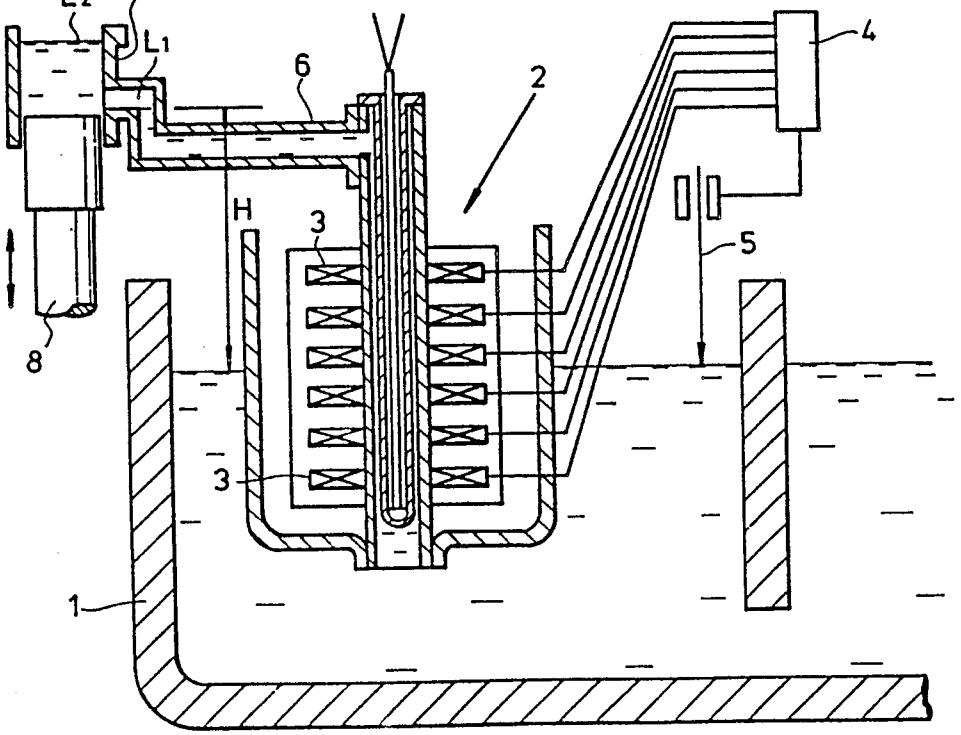
FIG. 2 (PRIOR ART)
FIG. 2 is a schematic block diagram showing a conventional electromagnetic molten metal supply system.

Referring to FIG. 1, an embodiment of the present invention will be described. The reference numerals used in the conventional example are used to designate same parts in the embodiment so that the description is simplified or omitted.

In FIG. 1, a plurality of exciting coils forming a cylindrical electromagnetic pump 12 immersed in a molten metal maintaining furnace 1 are divided in two groups of coils 3A and 3B: one group of coils 3A is used as a first exclusive coil for maintaining the molten metal surface in the furnace 1 and the other group 3B is used as a second exclusive coil for supplying the molten metal.

The two groups of coils 3A and 3B are each connected to separate control devices 4A and 4B respectively. More specifically, the group of coils 3A for maintaining the molten metal surface are connected to a control device (invertor) 4A for maintaining the molten metal surface, whereas the group of coil 3B for supplying the molten metal is connected to a control device (invertor)4B for supplying the molten metal. Further, the controller 4A for maintaining the molten metal surface and the controller 4B for supplying the molten metal are connected through an interface 12 to the controller 11 incorporated therein with a microcomputer.

A molten metal surface detecting instrument 5 for detecting a molten metal level in the molten metal maintaining furnace 1 in this embodiment has a float 5A provided with a detecting bar 5B. The vertical displacement of the detecting bar 5B is detected by a potentiometer 5C. The signal of the molten metal level detected by the molten metal surface detector 5 is supplied to the controller 11 after A/D conversion through an amplifier 13. Incidentally, the reference numeral 15 in FIG. 1 shows an AC three-phase power supply.

Based on the output signal from the molten metal surface detecting instrument 5, the controller 11 carries out operations on the exciting current of the group of coil 3A for maintaining the molten metal surface to maintain the water head H. The controller 4A for maintaining the molten metal surface is controlled through the interface 12 by the output of the controller 11, thereby the exciting current necessary for maintaining the molten metal surface is supplied to the group of coils 3A.

Further, when a molten metal supply command is supplied from the controller 11 to the group of coils 3B for supplying the molten metal, the exciting current needed for supplying the molten metal is supplied and adapted, for instance, to supply a fixed quantity of molten metal in the injection sleeve 7 by controlling a fixed exciting current for a given period of time. Moreover, the pump output of the coil for maintaining the surface of the molten metal is set larger than that of the coil for supplying the molten metal.

When the supply of the molten metal is completed, the subsequent command causes the injection plunger 8 to advance to inject the molten metal into the cavity of the die cast machine According to this embodiment, it is possible to use a standard energy saving type molten metal maintaining furnace with an expensive furnace for constantly maintaining the molten metal surface being and it is possible to control maintain the molten metal surface and the supply of the molten metal separately by means of a single electromagnetic pump, so that the effect of avoiding the variation of the supply quantity of the molten metal and obtaining superior die cast products can be achieved.

In addition, without increasing the cost for providing devices for controlling the respective group of coils 3A and 3B, the aforementioned effects can be attained with a simple constitution.

Further, in the above embodiment, the molten metal surface detecting instrument 5 is not limited to the structure illustrated and can be replaced with any other kind of instrument having the same function as the instrument 5.

Moreover, the first and second exclusive coils may be interchanged and the number of the coils may be set arbitrarily.

As has been described above, according to the present invention, it is possible to provide an electromagnetic molten metal supply system which can precisely maintain the molten metal surface and supply a fixed quantity of molten metal constantly by seperately controlling the molten metal surface of the molten metal furnace and the supply of the molten metal by means of a single electromagnetic pump.

What is claimed is:

1. An electromagnetic molten metal supply system comprising:

a supply tube;

an electromagnetic pump, disposed in a furnace, for maintaining molten metal and for supplying a fixed quantity of molten metal through the supply tube, said pump including an exciting coil arrangement comprising a first exclusive coil for maintaining a surface of the molten metal in the furnace and a second exclusive coil for supplying the molten metal;

a first control device for controlling the first exclusive coil;

a second control device for controlling the second exclusive coil; and a controller for supplying first and second control signals to said first and second control devices, said controller regulating a predetermined exciting current in accordance with the surface of the molten metal.

2. A system as defined in claim 1, wherein pump output responsive to the first exclusive coil is set larger than pump output responsive to the second exclusive coil.

3. A system as defined in claim 1, wherein the controller is adapted for at least receiving a detected signal indicative of the molten metal surface.

* * * * *